US007802424B2

(12) United States Patent
Kanzawa et al.

(10) Patent No.: US 7,802,424 B2
(45) Date of Patent: Sep. 28, 2010

(54) EXHAUST DEVICE IN COMBUSTION ENGINE, AND MOTORCYCLE THEREWITH

(75) Inventors: Tatsuhiko Kanzawa, Miki (JP); Kazumasa Wakahara, Kobe (JP); Naoki Tamai, Akashi (JP); Yota Katsukawa, Himeji (JP); Akira Soeda, Kobe (JP); Hidehiko Yamamoto, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 367 days.

(21) Appl. No.: 12/007,783

(22) Filed: Jan. 15, 2008

(65) Prior Publication Data

US 2008/0168767 A1 Jul. 17, 2008

(30) Foreign Application Priority Data

Jan. 15, 2007 (JP) ..... P2007-005767

(51) Int. Cl.
*F01N 1/00* (2006.01)

(52) U.S. Cl. ..... 60/324; 60/292; 60/289; 384/91; 251/227; 251/228; 251/251; 251/173

(58) Field of Classification Search ..... 60/324; 251/277–305, 173, 313; 137/15.25; 384/907, 384/908, 276

See application file for complete search history.

(56) References Cited

U.S. PATENT DOCUMENTS 5,364,682 A * 11/1994 Tanaka et al. ..... 428/138
6,109,899 A * 8/2000 Barito et al. ..... 418/55.5
6,273,058 B1 * 8/2001 Wagner ..... 123/323
6,607,820 B2 * 8/2003 Niwa et al. ..... 428/323
2003/0111628 A1 * 6/2003 Nanba et al. ..... 251/214
2005/0039448 A1 * 2/2005 Terashima ..... 60/323
2005/0081516 A1 * 4/2005 Inaoka et al. ..... 60/324
2006/0137650 A1 * 6/2006 Nakamura et al. ..... 123/337

FOREIGN PATENT DOCUMENTS

JP 2-101035 8/1990

* cited by examiner

*Primary Examiner*—Thomas E Denion
*Assistant Examiner*—Jesse Bogue
(74) *Attorney, Agent, or Firm*—Wenderoth, Lind & Ponack, L.L.P.

(57) ABSTRACT

An exhaust device for adjusting an exhaust gas cross sectional area of an exhaust passage in a combustion engine includes a valve body arranged in the exhaust passage communicating to an exhaust port of the combustion engine; a valve shaft fixed or integrally formed to the valve body and arranged so as to transverse the exhaust passage, the valve shaft changing the opening of the valve body by turning with the valve body about an axis of the valve shaft; a pair of bearing members for supporting rotatably the valve shaft at both ends thereof in a axial direction of the valve shaft; and a stopper arranged on the valve shaft so as to face an end face on the inward side of the exhaust passage of each bearing member in the axial direction. The stopper is restricted in the axial direction by the end face of each of the bearing members so that the valve body and the valve shaft do not move in the axial direction.

9 Claims, 9 Drawing Sheets

EXHAUST DEVICE IN COMBUSTION ENGINE, AND MOTORCYCLE THEREWITH

BACKGROUND OF THE INVENTION

1. Field of the Invention

The present invention relates to an exhaust device in a combustion engine for controlling an exhaust gas flow in an exhaust passage to enhance exhaust efficiency etc., and a motorcycle equipped with the exhaust device.

2. Description of the Prior Art

Generally, as shown in FIG. 11, an exhaust device in the combustion engine has a plate-shaped valve body (butterfly valve) 102 arranged in an exhaust passage 101 in an exhaust pipe unit 100. The valve body 102 is fixed to a valve shaft 103. Both ends of the valve shaft 103 are rotatably supported by left and right bearing members 105, 105. Exhaust gas flow is controlled by changing a rotation or turn angle (opening angle) of the valve body 102 according to an operation state of the combustion engine thereby enhancing the exhaust efficiency. When the engine is in high-speed rotation, output efficiency of the engine is enhanced by positioning the valve body 102 in a full-opened state as shown with a solid line. When the engine is in low-speed rotation or idling, generation of noise and the like is suppressed by positioning the valve body 102 in a substantially full-closed state as shown with a virtual line.

During operation of the combustion engine, temperature inside exhaust passage 101 becomes high due to heat of the exhaust gas, and thermal deformation occurs at the valve body 102 and the valve shaft 103. In this case, since the conventional valve shaft 103 is assembled to bearing members 105, 105 with a play (gap) of a predetermined clearance C3 in an axial direction of the valve shaft 103, it is possible to avoid a decrease in the smoothness in the operation of the valve body 102 by the thermal deformation.

In other words, stopper faces 108*a*, 108*a* facing end faces 105*a*, 105*a* on the inward side of the exhaust passage of each bearing member 105, 105 in the axial direction are arranged on both ends in the axial direction of the valve shaft 103, so that an interval L2 in the axial direction of the stopper faces 108*a*, 108*a* is shorter than an interval L1 in the axial direction of the end faces 105*a*, 105*a* of the bearing members 105, 105 by the predetermined interval C3 (e.g., about 1 mm to 2 mm).

The valve shaft 103 is biased to one side, such as the left side, in the axial direction by one coil spring 110, and at the same time, biased towards the valve opening side about an axis O1 of the valve shaft. That is, when the valve shaft 103 is biased towards the left side by the load in the axial direction of the coil spring 110, the left stopper face 108*a* comes into contact with the end face 105*a* of the left bearing member 105, and at the same time, the valve shaft 103 is biased towards the valve opening side by the restoration force in the torsional direction of the coil spring 110. The set load value in the axial direction by the coil spring 110 is about 5N (about 0.5 kgf) etc., and the set torsional torque value is about 350N·mm (35 kg·mm) etc. The prior art document includes Japanese Laid-Open Utility Model Publication No. H2-101035.

In a structure in which the valve shaft 103 is assembled with a play (clearance C3) in the axial direction as in FIG. 11, smoothness in the operation of the valve body 102 is maintained even if the valve shaft 103 etc., is thermally deformed. However, when dynamic pressure of the exhaust gas is applied on the valve body 102 in the exhaust gas flow direction and the vibration of the combustion engine is transmitted to the valve body 102 during the operation, the valve shaft 103 and the valve body 102 rattle thereby producing "rattling" noise, which might bring discomfort to the passenger. In particular, when closing the valve body 102 from the full-opened state shown with the solid line to the substantially full-closed state shown with the virtual line, the dynamic pressure of the exhaust gas acting on the valve body 102 becomes larger as the substantially full-closed state is approached. As a result, the valve body vibrates drastically near the substantially full-closed state, and the noise is likely to be produced.

In the case that a bushing made of metal is used as a bearing member 105, 105, an abrasion sound (metal sound) of "screeching" sound is produced between the metals when the valve body 102 is rotated if solid components in the exhaust gas such as carbon enters in the fitting surface of the bearing member 105 and the valve shaft 103, which might bring discomfort to the passenger.

SUMMARY OF THE INVENTION

The present invention addresses the above described condition, and an object of the present invention is to prevent production of noise caused by rattling of the valve shaft and the valve body in the exhaust device in the combustion engine. Another object is to maintain smoothness in the operation of the valve body while preventing production of abrasion sound between metals.

In order to accomplish these objects, an exhaust device is provided for adjusting an exhaust gas cross sectional area of an exhaust passage in a combustion engine, the exhaust device comprising: a valve body arranged in the exhaust passage communicating to an exhaust port of the combustion engine; a valve shaft fixed or integrally formed to the valve body and arranged so as to transverse the exhaust passage, the valve shaft changing the opening of the valve body by rotating with the valve body about an axis of the valve shaft; a pair of bearing members for rotatably supporting the valve shaft at both ends thereof in a axial direction of the valve shaft; and a stopper arranged on the valve shaft so as to face an end face on the inward side of the exhaust passage of each of the bearing members in the axial direction, the stopper being restricted in the axial direction by the end face of each of the bearing members so that the valve body and the valve shaft do not move in the axial direction.

With this configuration, since the valve shaft and the valve body are configured so as not to move in the axial direction of the valve shaft, the valve shaft and the valve body do not rattle even if dynamic pressure of the exhaust gas acts on the valve shaft and the valve body and the vibration of the combustion engine is transmitted to the valve shaft and the valve body during the operation of the combustion engine. Therefore, production of noise can be decreased. In particular, production of noise that is likely to occur when the valve body is closed to near the full-closed state is effectively decreased.

Preferably, at least one of the bearing members may be made of a flexible non-metal material as a main material.

With this configuration, even if each stopper of the valve shaft is contacted with each end face of the each bearing member, such contact portion is less likely to conglutinate, and the smoothness in the operation of the valve body can be maintained high. Furthermore, even if solid components such as carbon in the exhaust gas enter in the fitting part of the valve shaft and the bearing member, the abrasion sound etc. between the metals does not produce.

Preferably, the end face of the bearing member made of the non-metal material as the main material may be contacted with the stopper at a predetermined pressure.

With this configuration, the movement in the axial direction of the valve shaft and the valve body will be effectively prevented even if a strong external pressure is applied on the valve shaft and the valve body, and the bearing member expands in the radial direction, whereby the sealability of the fitting part of the bearing member and the valve shaft enhances.

Preferably, the bearing member made of the non-metal material as the main material may incorporate metal aggregate.

With this configuration, the strength of the bearing member will be maintained high even if the bearing member is bent.

Preferably, a coil spring may be arranged on the valve shaft for biasing the valve body in the axial direction of the valve shaft and biasing the valve body about the axis of the valve shaft; wherein a set torsional torque value about the axis by the coil spring with respect to the valve body may be set to a range of two times to ten times a set load value in the axial direction by the coil spring with respect to the valve body.

With this configuration, since the set torsional torque value of the coil spring is small and the load in the axial direction of the valve shaft is large, the valve body will be rotated with a small operation force when rotating the valve body in the valve closing side against the coil spring, whereby the valve shaft will be suppressed from falling and production of noise caused by such fall will be effectively prevented.

Preferably, the end face of the bearing member may be contacted with the stopper in a state of substantially zero pressure.

Preferably, a coil spring may be arranged on the valve shaft for biasing the valve body in the axial direction of the valve shaft and biasing the valve body about the axis of the valve shaft; wherein a set torsional torque value about the axis of the valve shaft by the coil spring with respect to the valve body may be substantially set to 80 to 90N·mm.

Preferably, a coil spring may be arranged on the valve shaft for biasing the valve body in the axial direction of the valve shaft and biasing the valve body about the axis of the valve shaft; wherein a set torsional torque value about the axis of the valve shaft by the coil spring with respect to the valve body may be substantially set to 80 to 90N·mm, and a set load value in the axial direction of the valve shaft may be substantially set to 15N.

The present invention provides a motorcycle having satisfactory exhaust efficiency and capable of effectively preventing noise by arranging the exhaust device of the combustion engine configured as above.

BRIEF DESCRIPTION OF THE DRAWINGS

The above and other objects, features and advantages of the present invention will become more apparent from the following description taken in connection with the accompanying drawings in which.

DETAILED DESCRIPTION OF THE PREFERRED EMBODIMENTS

First Embodiment

FIGS. 1 to 7 show an exhaust device according to a first embodiment of the present invention and an exhaust apparatus of a combustion engine for a motorcycle equipped with the same, and the first embodiment of the present invention will be described based on such drawings.

Figure 1:
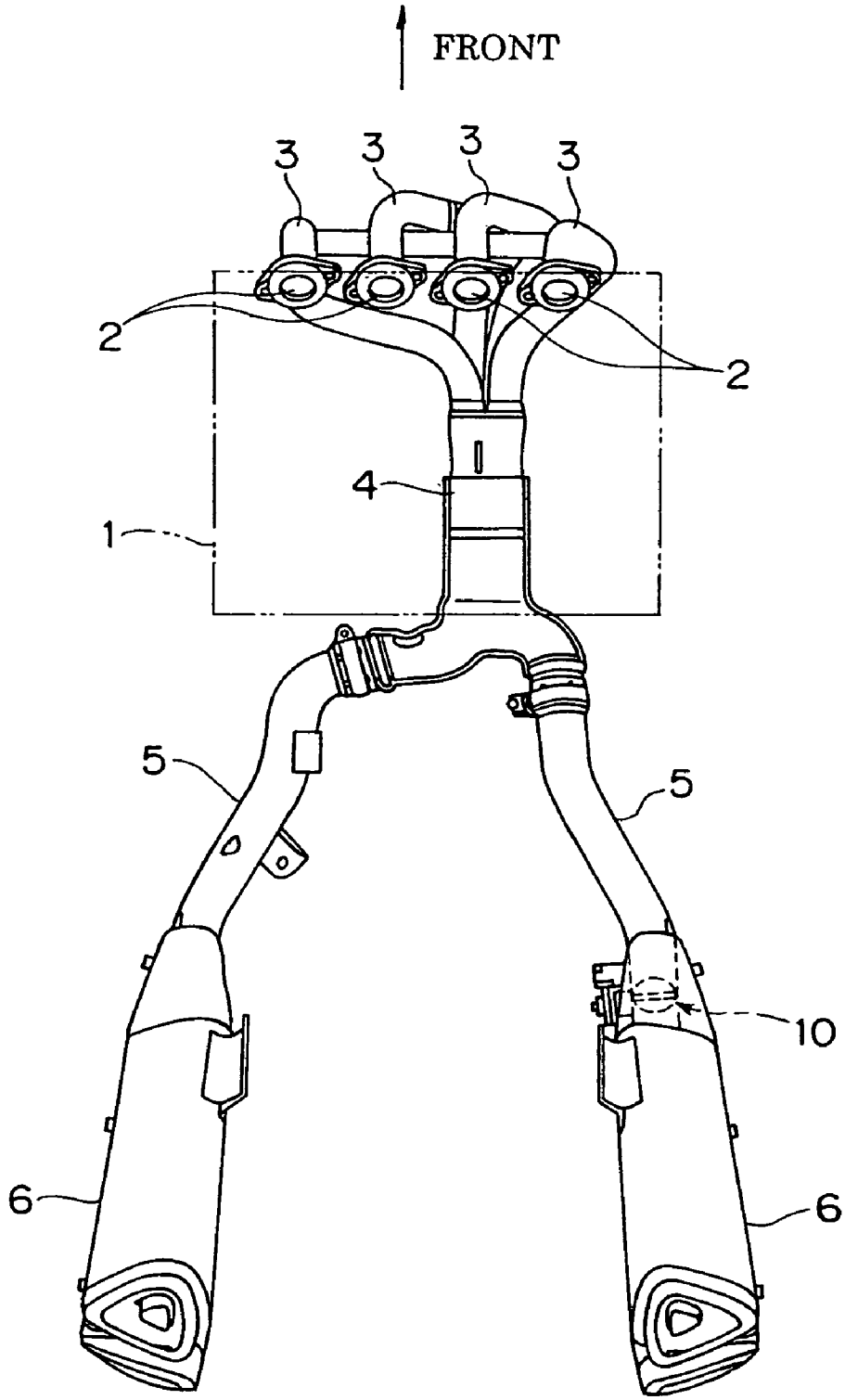
FIG. 1 is a plan view of an exhaust apparatus in a combustion engine equipped with an exhaust device according to a first embodiment of the present invention.
Figure 2:
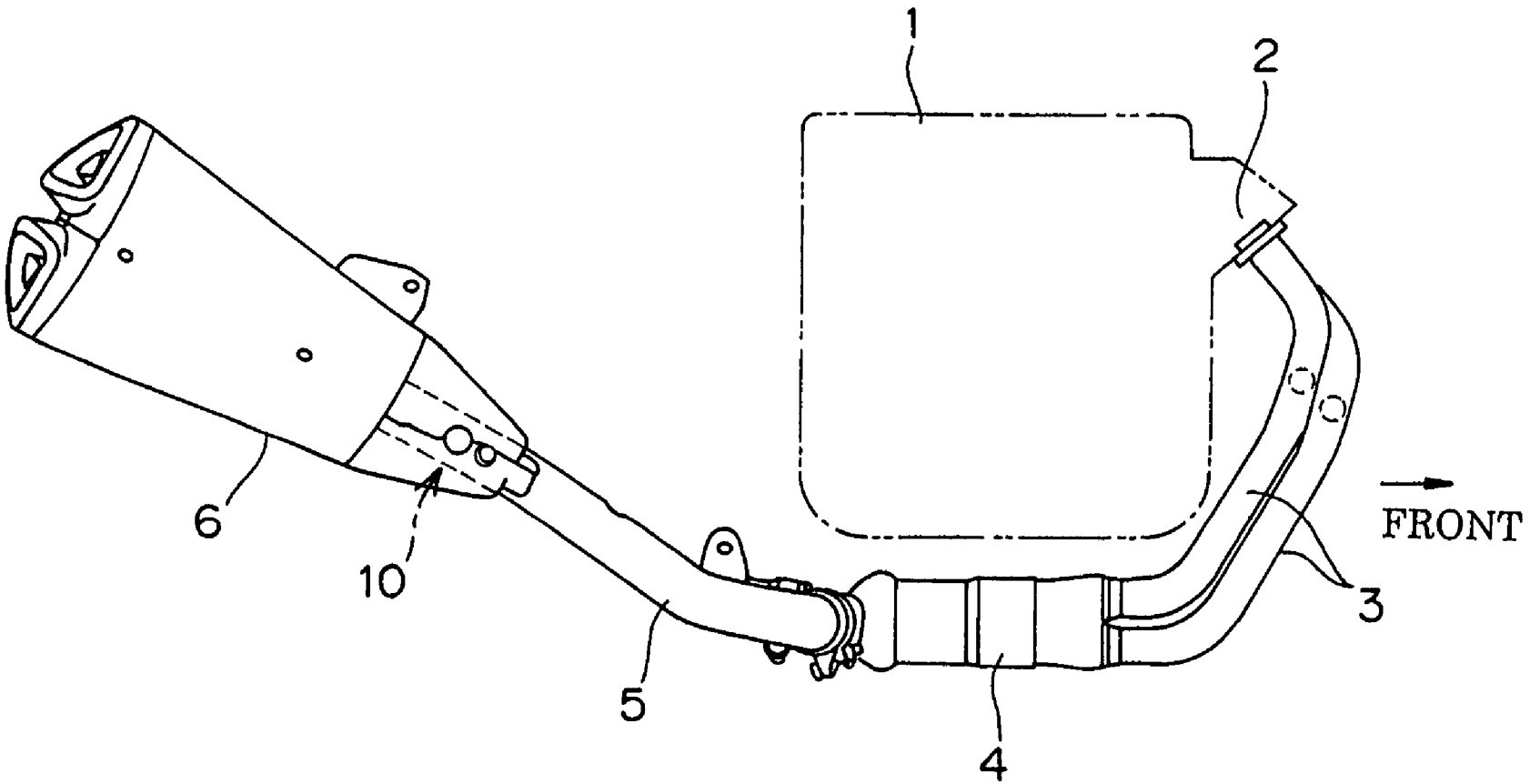
FIG. 2 is a right side view of FIG. 1.

FIG. 1 is a plan view of the exhaust apparatus in the combustion engine, and FIG. 2 is a right side view of the exhaust apparatus of FIG. 1. "Front" indicated by an arrow is the advancing direction of a vehicle. In FIG. 1, the combustion engine 1 is an inline-type 4-cylinder engine, where individual exhaust pipes 3, 3, 3, 3 are connected to corresponding exhaust ports 2, 2, 2, 2 formed at a front surface of four cylinders of the engine 1, and the four individual exhaust pipes 3, 3, 3, 3 are extended downward along the front side of the combustion engine 1, curved backward near the lower front end of the engine 1, and collected by a collection pipe 4. The collection pipe 4 is arranged under the engine 1 and incorporates catalytic agent etc. An exhaust downstream end of the collection pipe 4 is branched into left and right exhaust branch pipes 5, 5. A left exhaust muffler 6 is directly connected to an exhaust downstream end of the left exhaust branch pipe 5, and a right exhaust muffler 6 is connected to an exhaust downstream end of the right exhaust branch pipe 5 by way of an exhaust device 10.

In FIG. 2, the exhaust branch pipe 5, 5 and the exhaust muffler 6, 6 are inclined upward backward, and the exhaust device 10 is also inclined upward backward.

Figure 3:
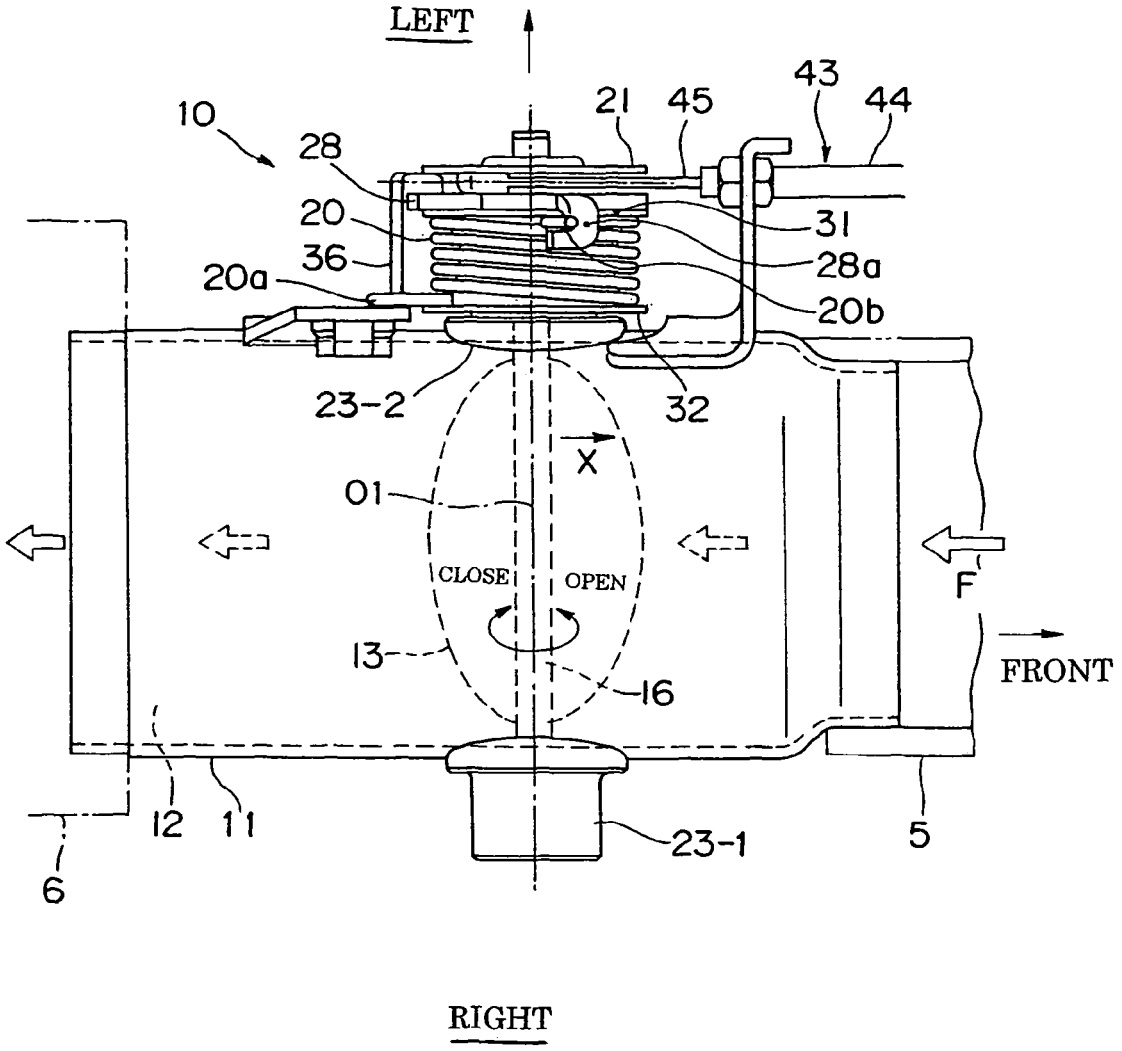
FIG. 3 is an enlarged plan view of FIG. 1.
Figure 4:
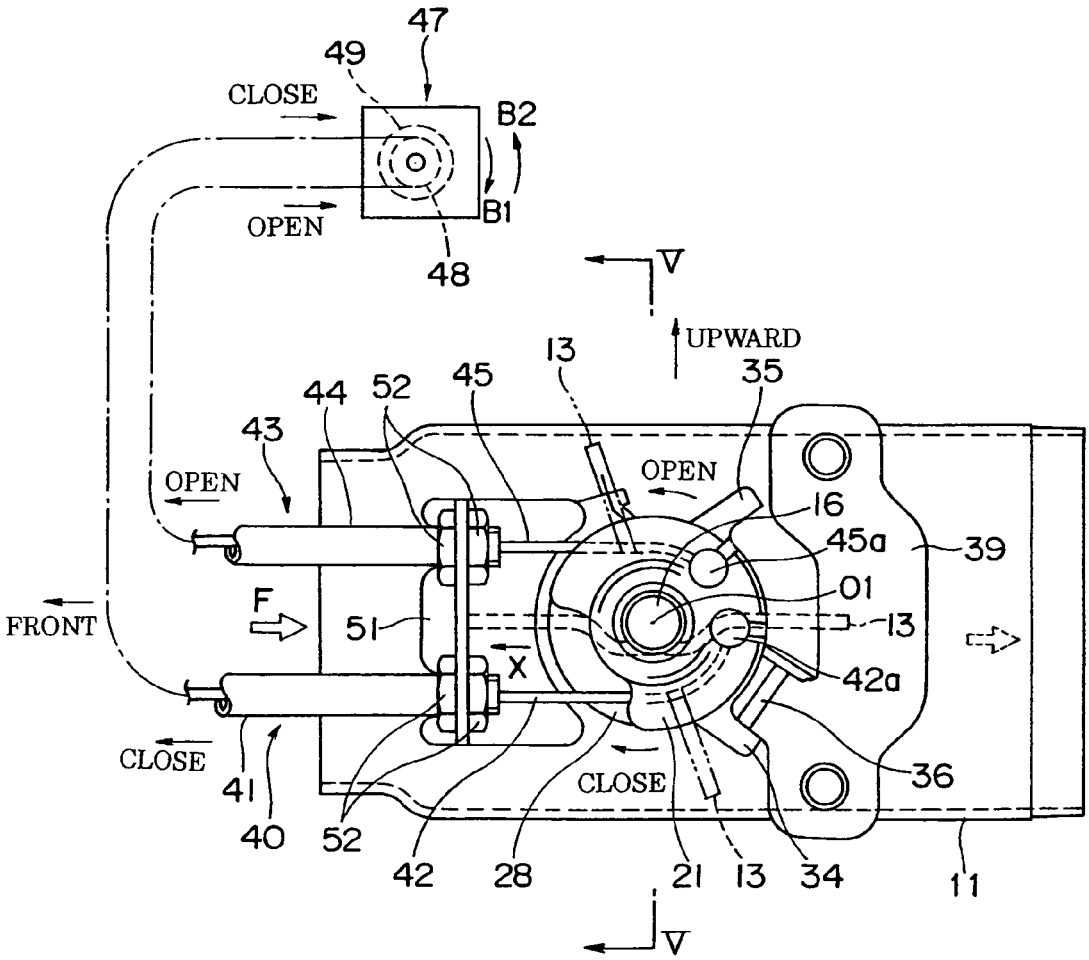
FIG. 4 is a left side view of the exhaust device of FIG. 3.
Figure 5:
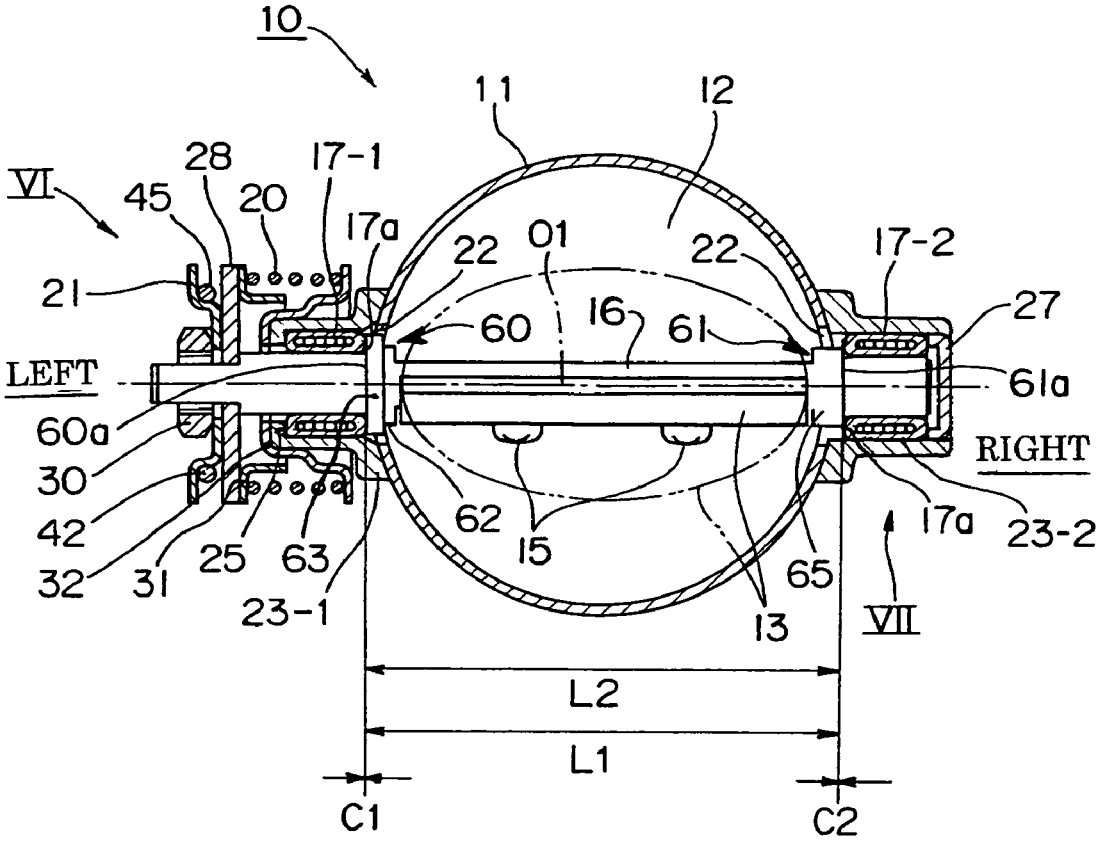
FIG. 5 is a cross sectional view taken along line V-V of FIG. 4.
Figure 6:
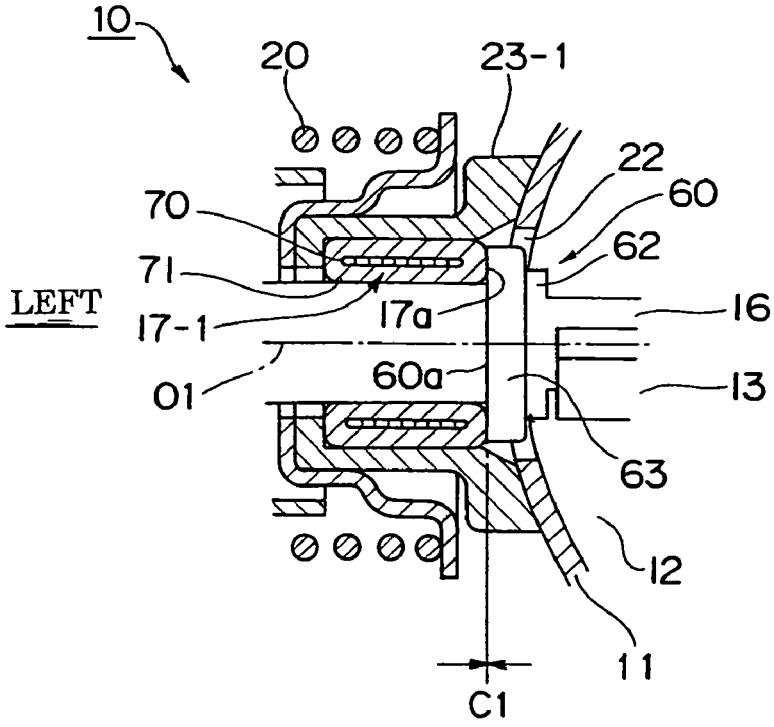
FIG. 6 is an enlarged cross sectional view of an arrow VI portion of FIG. 5.
Figure 7:
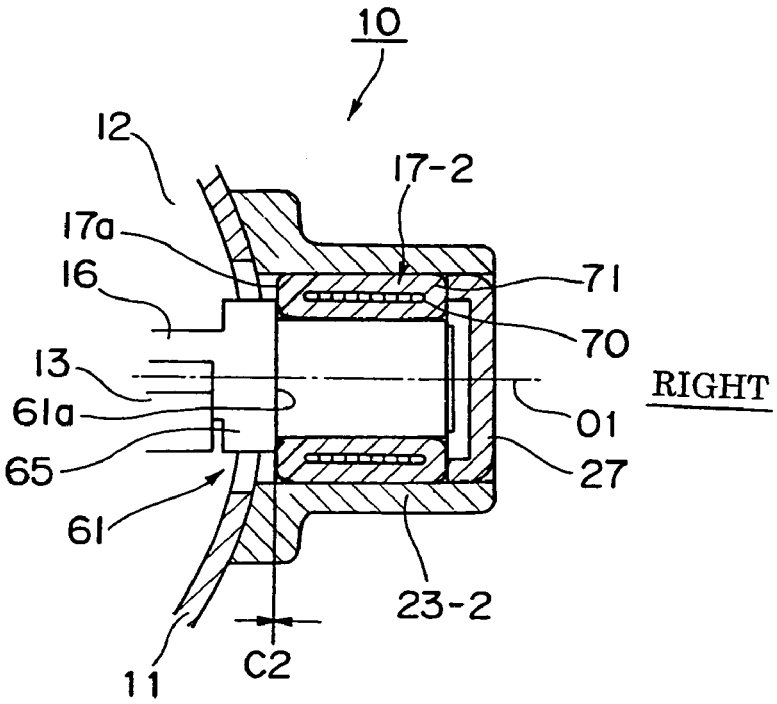
FIG. 7 is an enlarged view of an arrow VII portion of FIG. 5.

FIG. 3 is an enlarged plan view of the exhaust device 10, FIG. 4 is a left side view of the exhaust device 10, FIG. 5 is a cross sectional view taken along line V-V of FIG. 4, FIG. 6 is an enlarged cross sectional view of an arrow VI portion (near left bearing member) of FIG. 5, and FIG. 7 is an enlarged cross sectional view of an arrow VII portion (near right bearing member) of FIG. 5.

First, an outline of the exhaust device 10 will be described. In FIG. 5, the exhaust device 10 includes a cylindrical metal exhaust pipe 11 forming an exhaust passage 12, a metal valve body (butterfly valve) 13 of circular plate shape arranged in the exhaust passage 12, a valve shaft 16 fixed to the valve body 13 with a screw 15 and traversing the exhaust passage 12 in the left and the right direction so as to pass through the center of the exhaust passage 12, a pair of left and right bearing members 17-1, 17-2 for supporting rotatably left and right ends of the valve shaft 16, a coil spring 20 for applying a load in the axial direction of the valve shaft 16 and a torsional torque about an axis O1 of the valve shaft on the valve shaft 16, and a driven pulley 21 for rotating the valve shaft 16 and the valve body 13 about the axis O1.

A structure of each section of the exhaust device 10 will now be described in detail. For the sake of convenience of the explanation, the axial direction of the valve shaft 16 is referred to simply as "axial direction" in the following description. A pair of shaft insertion holes 22, 22 is formed at both left and right ends of the exhaust pipe 11 respectively, and a pair of left and right bearing housings 23-1, 23-2 is fixed at both left and right ends of the exhaust pipe unit 11 by welding the entire periphery thereof. The left and right bearing members 17-1, 17-2 are press-fit to the inner peripheral surface of the corresponding bearing housing 23-1, 23-2. An inward flange 25 is integrally formed at a left end of the left bearing housing 23-1, and the left bearing member 17-1 is stopped by the inward flange 25 so as not to move towards the left side. A cup-shaped metal cap 27 is fitted to the inner peripheral surface of a right end of the right bearing housing 17-2, and the cap 27 is fixed to the right bearing housing 23-2 at a plurality of sites by spot welding, whereby the right bearing member 17-2 is stopped by the left end face of the cap 27 so as not to move towards the right side.

The left end of the valve shaft 16 is passed through the inward flange 25 of the left bearing housing 23-1 and projected to the left side, and the driven pulley 21 and a rotating end limiting plate 28 are fixed to a left projecting part of the valve shaft 16 with a nut 30. A pair of left and right spring receiving plates 31, 32 is arranged between the left bearing housing 23-1 and the rotating end restricting plate 28, and the coil spring 20 is arranged in a contracted manner in the axial direction between the spring receiving plates 31, 32.

In FIG. 4, a direction indicated by the arrow "close" is the valve closing direction about the axis O1 of the valve shaft 16, and a direction indicated by the arrow "open" is a valve opening direction about the axis O1 of the valve shaft 16. A rotating position of the valve body 13 shown by a broken line is a full-opened position substantially parallel to an exhaust flow direction F, and a rotating position of the valve body 13 shown with a virtual line is a substantially full-closed position (minimum opened position) substantially orthogonal to the exhaust flow direction F. A projection 34 for restricting the valve body 13 at the full-opened position and a projection 35 for restricting the valve body 13 at a substantially full-closed position are formed on the rotating end restricting plate 28, where an engagement strip 36 is arranged between the circumferential directions of the projections 34, 35, the engagement strip 36 being integrally formed with a cover mounting plate 39 fixed to the exhaust pipe unit 11. That is, the projection 34 for restricting valve opening side comes into contact with the engagement strip 36 when the valve shaft 16 and the valve body 13 are rotated in the valve opening direction up to the full-opened position shown with a broken line, whereas the projection 35 for restricting valve closing side comes into contact with the engagement strip 36 when the valve shaft 16 and the valve body 13 are rotated in the valve closing direction up to the substantially full-closed position shown with a virtual line.

In FIG. 3, one end 20*a* of the coil spring 20 is engaged with the engagement strip 36, and another end 20*b* of the coil spring 20 is engaged with a projection 28*a* formed on the rotating end restricting plate 28. The coil spring 20 is arranged in a contracted manner between the pair of left and right spring receiving plates 31, 32 as described above, so that the valve shaft 16 and the valve body 13 are biased towards the left side in the axial direction with a predetermined set load value, and the at the same time, the valve shaft 16 and the valve body 13 are biased in the valve opening direction at a predetermined set torsional torque value by being assembled while being twisted in the valve closing direction about the axis O1. The set load value in the axial direction of the coil spring 20 in time of assembly is about 15N (about 1.5 kgf) etc., and the set torsional torque value is about 80 to 90N·mm (8 to 9 kg·mm).

In FIG. 4, one end (large drum shaped part) 42*a* of an inner cable 42 of a valve closing cable device 40 and one end (large drum shaped part) 45*a* of an inner cable 45 of a valve opening cable device 43 are respectively engaged to the driven pulley 21, where both inner cables 42, 45 are wound to the driven pulley 21 and extended forward, inserted to corresponding outer cables 41, 44 respectively. The outer cables 41,44 and the inner cables 42, 45 are extended to a drive unit 47. The outer cables 41, 44 are connected to a drive unit 47, and the inner cables 42, 45 are connected with a drive pulley 48 of the drive unit 47. The drive pulley 48 is connected to an output shaft of a drive motor 49. One end of each outer cable 41, 44 is fixed to a supporting plate with a pair of nuts 52. The supporting plate is fixed to the exhaust pipe 11

When the drive pulley 48 is rotated in the direction of the arrow B1, the valve closing inner cable 42 is pulled, and the valve shaft 16 and the valve body 13 rotate in the valve closing direction with the driven pulley 21 against the elastic force (torsional force in the rotating direction) of the coil spring 20. When the drive pulley 48 is rotated in the direction of the arrow B2, on the other hand, the valve opening inner cable 44 is pulled, and the valve shaft 16 and the valve body 13 rotate in the valve opening direction with the driven pulley 21 with the help of the restoration force in the valve opening direction of the coil spring 20.

FIG. 6 is an enlarged cross sectional view of the left bearing member 17-1 described above, where the left bearing member 17-1 uses graphite composite heat resistant bearing and is configured by an aggregate 70 having a knitted mesh form of fine wires of stainless steel and graphite 71 filled into the aggregate 70 at high pressure. The graphite 71 consists of carbon component, as well known, and has flexibility, excels in lubricating property, heat resistant property, acid-proof/alkali-proof property, and sufficiently functions as a solid lubricant.

FIG. 7 is an enlarged cross sectional view of the right bearing member 17-2 described above, where the right bearing member 17-2 also uses graphite composite heat resistant bearing having flexibility and is configured by the aggregate 70 having a knitted mesh form of fine wires of stainless steel and the graphite 71 filled into the aggregate 70 at high pressure, similar to the left bearing member 17-1 of FIG. 6.

In FIG. 5, stoppers 60, 61 facing end faces 17*a*, 17*a* in the axial direction on an inward side of the exhaust passage of each bearing member 17-1, 17-2 are arranged on the left and right ends of the valve shaft 16 to restrict the movement of the valve shaft 16 in the axial direction (left and right direction). The interval L2 in the axial direction of stopper faces 60*a*, 61*a* of the stoppers 60, 61 is set to be the same as the interval L1 in the axial direction of the end faces 17*a*, 17*a* on the inward side of the exhaust passage of the left and right bearing members 17-1, 17-2. Thus, the valve body 13 and the valve shaft 16 are restricted from moving in either to the left or the right in the axial direction.

In FIG. 6, the left stopper 60 is configured by an outward left flange 62 integrally molded to the valve shaft 16, and a metal ring 63 arranged between the left flange 62 and the right end face 17*a* of the left bearing member 17-1. The left end face of the left flange 62 is contacted with the right end face of the metal ring 63, and the left end face (stopper face 60*a*) of the metal ring 63 is contacted with the right end face 17*a* of the left bearing member 17-1 also. That is, a clearance C1 between the stopper face 60*a* and the right end face 17*a* of the left bearing member 17-1 is maintained at "0", thereby restricting the movement of the valve shaft 16 towards the left side. In the case that the clearance C1 is set at "0", it is possible to assemble the left stopper 60 so that the contacting pressure of the stopper face 60*a* and the right end face 17*a* of the left bearing member 17-1 becomes "0". However, in the present embodiment, assembly is performed in a state where the stopper face 60*a* is contacted with the right end face 17*a* of the left bearing member 17-1 at a constant pressure.

In FIG. 7, the right stopper 61 is configured only by an outward right flange 65 integrally molded to the valve shaft 16, where the right end face (stopper face 61*a*) of the right flange 65 is contacted with the left end face 17*a* of the right bearing member 17-2. That is, a clearance C2 in the axial direction of the stopper face 61*a* and the left end face 17*a* of the right bearing member 17-2 is maintained at "0", thereby restricting the movement of the valve shaft 16 towards the right side.

In the case that the clearance C2 is set at "0", it is possible to assemble the right stopper 61 so that the contacting pressure of the stopper face 61*a* and the left end face 17*a* of the right bearing member 17-2 becomes "0". However, in the present embodiment, assembly is performed in a state where the stopper face 61*a* is contacted with the left end face 17*a* of the right bearing member 17-2 at a constant pressure, similar to the left bearing member 17-1.

An assembly procedure of the exhaust device 10 will now be described.

(1) In FIG. 5, before the assembly, the left and right bearing housings 23-1, 23-2 are fixed to the locations corresponding to the shaft insertion holes 22, 22 on both left and right ends of the exhaust pipe 11 in advance by welding.

(2) The left bearing member 17-1 is press-fit to the inner peripheral surface of the left bearing housing 23-1, and stopped by the inward flange 25 so as not to move towards the left side in the axial direction. The valve shaft 16 fitted with the metal ring 63 and the right bearing member 17-2 is then inserted into the exhaust passage 12 from the shaft insertion hole 22 on the right side, the left end of the valve shaft 16 is inserted to the left bearing member 17-1, and the right bearing member 17-2 is press-fit to the right bearing housing 23-2.

(3) The cap 27 is fitted in the right bearing housing 23-2, the right bearing member 17-2 is pressed towards the left side at a constant pressure with the cap 27, and the cap 27 is fixed to the right bearing housing 23-2 by welding.

(4) The spring receiving plates 31, 32 and the coil spring 20 are attached to the outer peripheral surface of the left end of the valve shaft 16 from the left side, the rotating end restricting plate 28 and the driven pulley 21 are fitted in, and the nut 30 is screwed to an external thread at the left end of the valve shaft 16 to fix the rotating end restricting plate 28 and the driven pulley 21 to the valve shaft 16 and compress the coil spring 20 in the axial direction. Furthermore, the ends 20*a*, 20*b* of the coil spring 20 are engaged to the engagement strip 36 and the projection 28*a* as in FIG. 3 so as to be assembled while being twisted by a predetermined amount in the valve closing direction.

(5) Finally, the valve body 13 is inserted from one opening of the exhaust pipe unit 11, and fixed to the valve shaft 16 with the screw 15 as shown in FIG. 5.

Such assembly procedure is merely an example, and the left bearing housing 23-1 may be press-fit with the left bearing member 17-1 attached to the valve shaft 16.

Describing the general operation of the exhaust device 10, the flow of exhaust gas is controlled by changing (adjusting) the opening of the valve body 13 in the exhaust passage 12, that is, the flow cross sectional area of the exhaust gas according to various operating conditions. As an operating condition, for example, the combustion engine load is detected by means of the load sensor. When the engine 1 is under high load operation, the opening of the valve body 13 is made large to rapidly exhaust the exhaust gas and enhance the output of the engine 1. On the contrary, when the engine 1 is under low load operation, the opening of the valve body 13 is made small to increase the back pressure and attenuate the exhaust pulsation thereby reducing the exhaust noise.

In another operating condition, the vehicle speed is detected by means of a vehicle speed sensor. When the engine 1 is under high speed operation, the opening of the valve body 13 is made large. Contrary, when the engine is low speed operation, the opening of the valve body is made small.

(1) In FIG. 3, during the operation of the combustion engine, the dynamic pressure of the exhaust gas acts on the valve body 13 and the valve shaft 16, whereby the bending load applies on the valve body 13 and the valve shaft 16 in the exhaust gas flow direction F. The bending load increases with the rotating of the valve body 13 in the valve closing direction and tends to vibrate the valve body 13 and the valve shaft 16 in cooperation with the vibration of the combustion engine. In this embodiment, since the valve shaft 16 and the valve body 13 are restricted from moving either to the left or the right in the axial direction by the stoppers 60, 61 arranged at both ends of the valve shaft 16, the valve shaft 16 and the valve body 13 will not rattle, and production of noise caused by impact etc. of the valve shaft 16 and the bearing members 17-1, 17-2 is prevented.

(2) In FIGS. 6 and 7, since the flexible member made of non-metal material as the main material such as graphite composite heat resistant bearing is used for the bearing members 17-1, 17-2, the smoothness in the operation of the valve body 13 is maintained even in a structure in which the valve shaft 16 and the valve body 13 are restricted from moving in either the left or the right in the axial direction. In particular, if the bearing members 17-1, 17-2 are incorporated in a state pressurized in the axial direction by each stopper 60, 61, the bearing members 17-1, 17-2 expand in the radial direction, thereby enhancing the sealability of the fit-in parts of the valve shaft 16 and the bearing members 17-1, 17-2.

Figure 11:
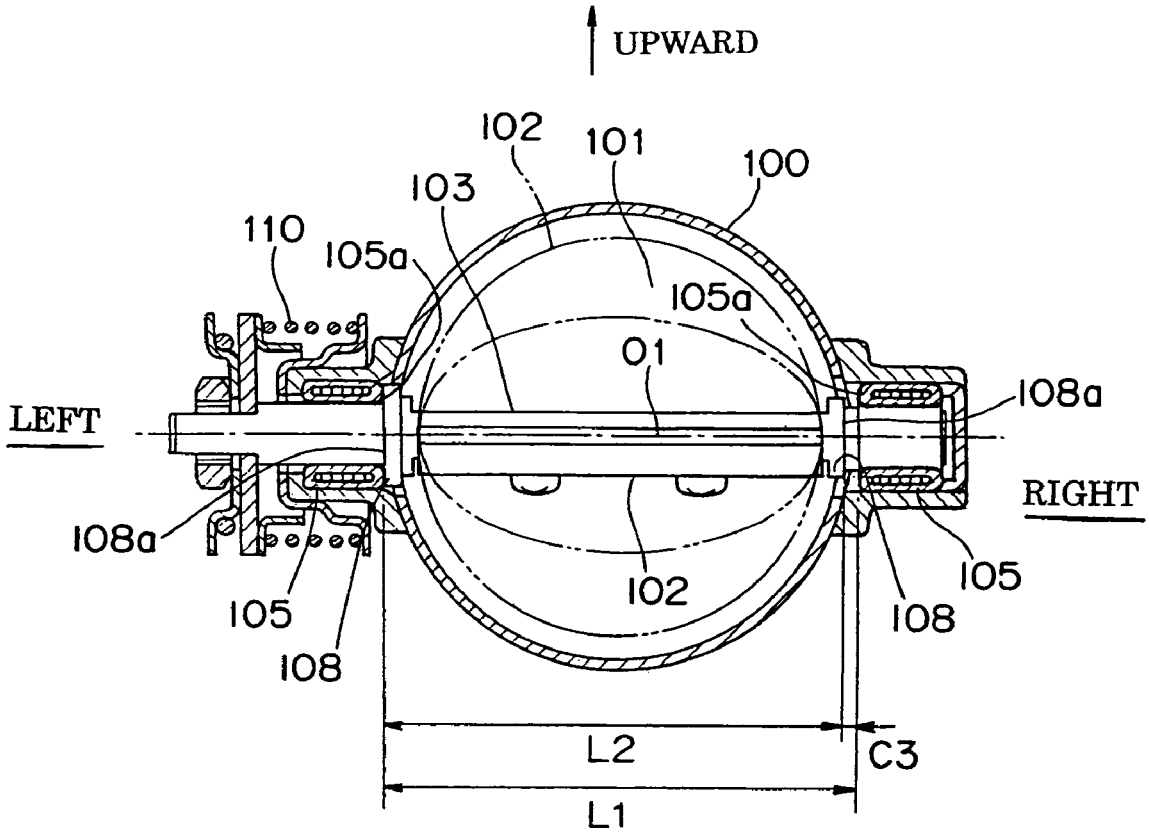
FIG. 11 is a cross sectional view of a conventional exhaust device.

(3) Compared to the prior art of FIG. 11, the set torsional torque value of the coil spring 20 is reduced to about ¼, that is, reduced from about 350N·mm to about 80 to 90N·mm, and the set load value in the axial direction of the coil spring 20 is increased to about three times, that is, from about 5N to about 15N, and thus when the driven pulley 21 and the valve shaft 16 are rotated in the valve closing direction against the coil spring 20 by the valve closing cable device 40, as shown in FIG. 4, the operation force is greatly reduced, the driven pulley 21 and the valve shaft 16 can be rotated with a small operation force, and the valve shaft 16 is prevented from falling in the direction of the arrow X in FIG. 3. That is, production of vibration caused by the fall of the valve shaft 16 is prevented, and the production of noise is effectively prevented.

(4) In FIG. 5, since the valve shaft 16 and the valve body 13 are restricted so as not to move in either the left or the right in the axial direction, the area of the valve body 13 can be increased compared to the exhaust device equipped with the valve body 103 that can move in the axial direction as in FIG. 11. Thus, the gap between the outer peripheral end of the valve body 13 and the inner peripheral surface of the exhaust pipe unit 11 can be made small in the substantially full-closed state, and the exhaust gas shielding effect in the substantially full-closed state is enhanced.

Second Embodiment

Figure 8:
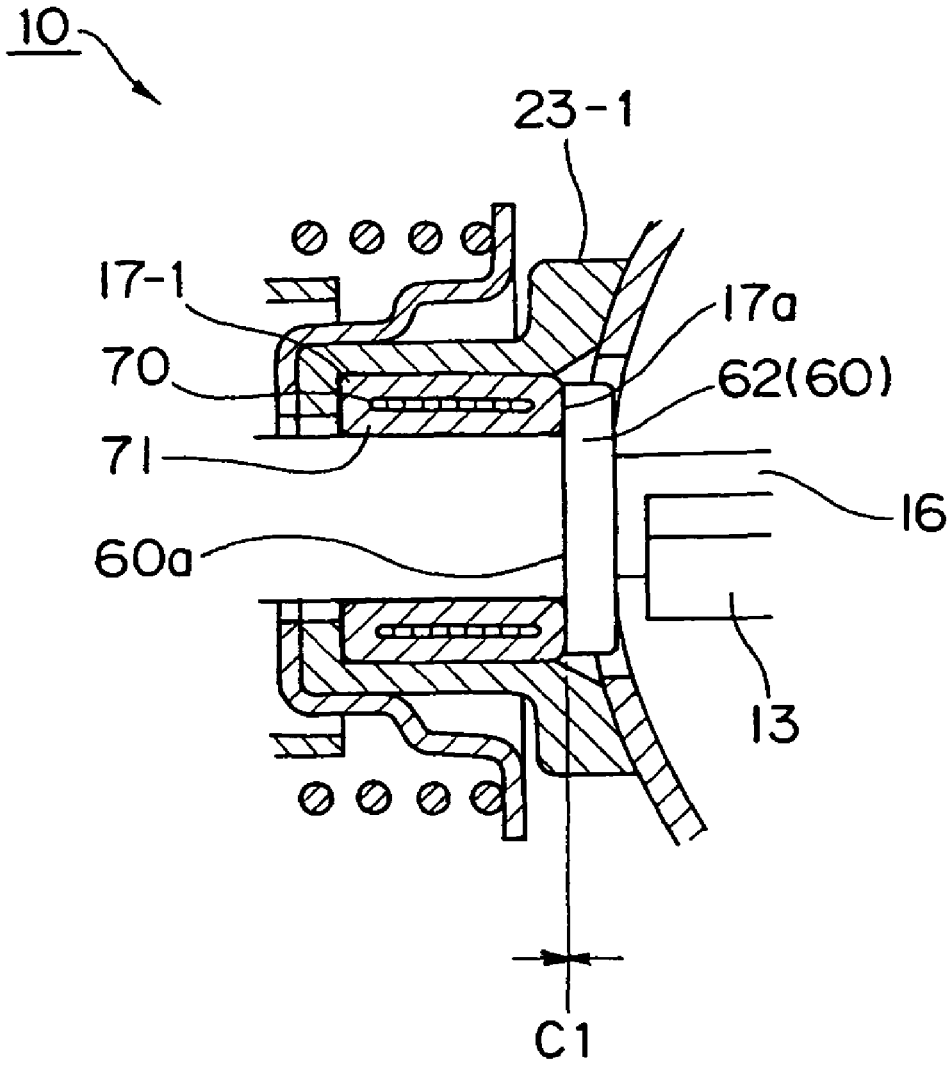
FIG. 8 shows a second embodiment and is an enlarged cross sectional view showing the same portion as FIG. 6.

FIG. 8 shows a second embodiment and is an enlarged cross sectional view showing the same portion as FIG. 6. In the second embodiment, the left stopper 60 is configured only by the left flange 62 integrally molded to the valve shaft 16. Other configurations are the same as in the first embodiment, and the same reference numerals are denoted for the same components.

Third Embodiment

Figure 9:
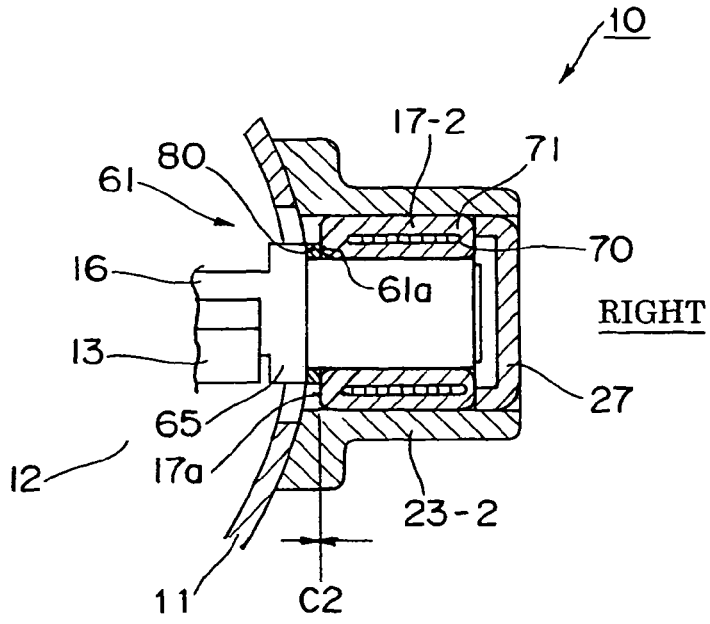
FIG. 9 shows a third embodiment and is an enlarged cross sectional view showing the same portion as FIG. 7.

FIG. 9 shows a third embodiment and is an enlarged cross sectional view showing the same portion as FIG. 7. In the third embodiment, the right stopper 61 is configured by an outward right flange 65 integrally molded to the valve shaft 16, and a ring shaped metal spacer 80 sandwiched between the right flange 65 and the right bearing member 17-2. The left stopper 60 may be either a configuration combining the ring 63 and the left flange 62 as in FIG. 6 or a configuration including only the left flange 62 as in FIG. 8. Other configurations are the same as in the first embodiment, and the same reference numerals are denoted for the same components.

Fourth Embodiment

Figure 10:
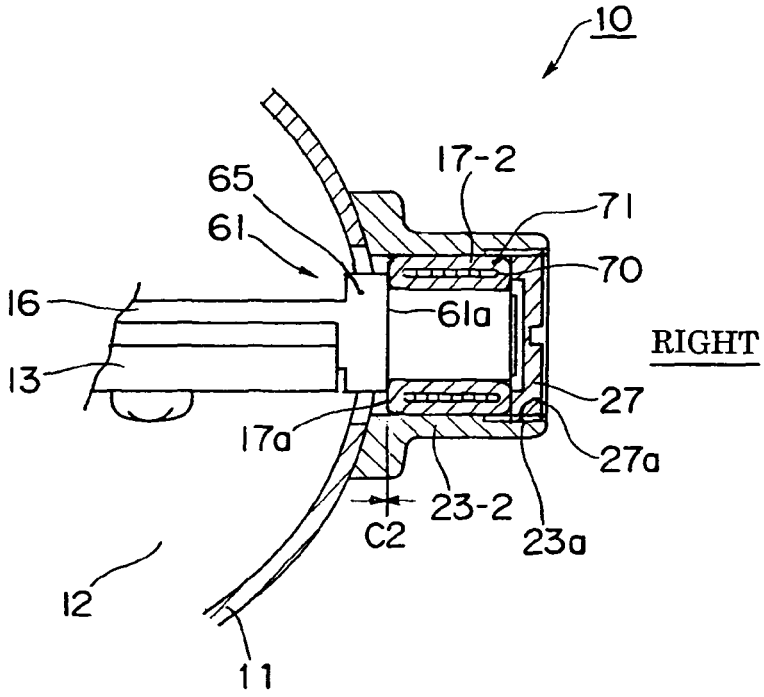
FIG. 10 shows a fourth embodiment and is an enlarged cross sectional view showing the same portion as FIG. 7.

FIG. 10 shows a fourth embodiment and is an enlarged cross sectional view showing the same portion as FIG. 7. In the fourth embodiment, an external thread 27*a* is formed at the outer periphery of the cap 27 for closing the right bearing housing 23-2, an internal thread 23*a* is formed on the inner peripheral surface of the right bearing housing 23-2, and the cap 27 is screwed to the internal thread 23*a*. Other configurations are the same as in the first embodiment, and the same reference numerals are denoted for the same components. According to the fourth embodiment, the load in the axial direction applied to the right bearing member 17-2 by the cap 27 can be changed even after the assembly.

Other Embodiments (1) One of either the left or the right bearing member 17-1, 17-2 may be a metal bushing. The flexible bearing members 17-1, 17-2 having non-metal material as the main material preferably has graphite as the main material, but may be made from thermosetting resin having heat resistance.

(2) In each embodiment, the valve shaft 16 and the valve body 13 are formed as separate bodies and are coupled with the screw 15, but the valve shaft 16 and the valve body 13 may be an integrated molding. In this case, the valve shaft 16 may be formed in a state divided to both ends in the radial direction of the valve body 13.

(3) The present invention is not limited to the configuration of each embodiment mentioned above, and encompasses various variants without deviating from the scope of the claims.

What is claimed is:

1. An exhaust device for adjusting an exhaust gas cross sectional area of an exhaust passage communicating with an exhaust port of a combustion engine, the exhaust device comprising:

an exhaust pipe forming the exhaust passage;

a valve body arranged in the exhaust passage;

a valve shaft fixed or integrally formed to the valve body and arranged so as to extend across the exhaust passage, the valve shaft changing the opening of the valve body by rotating with the valve body about an axis of the valve shaft;

a pair of bearing members for rotatably supporting the valve shaft at both ends thereof in an axial direction of the valve shaft, each of the bearing members having an end face facing in the axial direction of the valve shaft, and each end face being on a side of the bearing member closest to the exhaust passage; and a pair of stoppers arranged on the valve shaft so as to face the end faces of the bearing members, respectively, the stoppers being restricted in the axial direction by the end face of each of the bearing members so that the valve body and the valve shaft do not move in the axial direction, wherein at least one of the bearing members is composed of an aggregate and a flexible graphite member, the aggregate having a knitted mesh form of fine wires of stainless steel, and the flexible graphite member being filled into the aggregate at high pressure so as to surround the aggregate, and wherein the valve body and the valve shaft are installed in the exhaust pipe such that the stoppers contact the end faces of the bearing members, respectively, at a constant pressure.

2. The exhaust device of claim 1, wherein the end face of each of the bearing members is formed by the flexible graphite member.

3. The exhaust device of claim 1, further comprising a coil spring on the valve shaft biasing the valve body in the axial direction of the valve shaft and rotationally biasing the valve body about the axis of the valve shaft;

wherein the coil spring is configured such that a set torsional torque value applied by the coil spring about the axis of the valve shaft is set to a range of two times to ten times a set load value applied by the coil spring in the axial direction.

4. The exhaust device of claim 1, wherein the end face of at least one of the bearing members contacts the respective stopper in a state of substantially zero pressure.

5. The exhaust device of claim 1, further comprising a coil spring on the valve shaft biasing the valve body in the axial direction of the valve shaft and rotationally biasing the valve body about the axis of the valve shaft;

wherein the coil spring is configured such that a set torsional torque value applied by the coil spring about the axis of the valve shaft is about 80 to 90N·mm.

6. The exhaust device of claim 1, further comprising a coil spring on the valve shaft biasing the valve body in the axial direction of the valve shaft and rotationally biasing the valve body about the axis of the valve shaft;

wherein the coil spring is configured such that a set torsional torque value applied by the coil spring about the axis of the valve shaft is about 80 to 90N·mm, and a set load value applied by the coil spring in the axial direction of the valve shaft is about 15N.

7. A motorcycle equipped with the exhaust device of claim 1.

8. The exhaust device of claim 1, wherein both bearing members are composed of an aggregate and a flexible graphite member, the aggregate having a knitted mesh form of fine wires of stainless steel, and the flexible graphite member being filled into the aggregate at high pressure so as to surround the aggregate.

9. The exhaust device of claim 4, further comprising a coil spring on the valve shaft biasing the valve body in the axial direction of the valve shaft and rotationally biasing the valve body about the axis of the valve shaft;

wherein the coil spring is configured such that a set torsional torque value applied by the coil spring about the axis of the valve shaft is about 80 to 90N·mm, and a set load value applied by the coil spring in the axial direction of the valve shaft is about 15N.

* * * * *